US008851622B2

(12) United States Patent
Leoni et al.

(10) Patent No.: US 8,851,622 B2
(45) Date of Patent: Oct. 7, 2014

(54) PRINTERS, METHODS, AND APPARATUS TO REDUCE AEROSOL

(75) Inventors: Napoleon J Leoni, San Jose, CA (US); Omer Gila, Cupertino, CA (US); Michael H Lee, San Jose, CA (US); Henryk Birecki, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/878,720

(22) PCT Filed: Oct. 29, 2010

(86) PCT No.: PCT/US2010/054816

§ 371 (c)(1), (2), (4) Date: Apr. 10, 2013

(87) PCT Pub. No.: WO2013/039462

PCT Pub. Date: Mar. 21, 2013

(65) Prior Publication Data

US 2013/0215194 A1 Aug. 22, 2013

(51) Int. Cl.

| | |
|---|---|
| ***B41J 2/165*** | (2006.01) |
| ***B41J 11/00*** | (2006.01) |
| *G03G 15/10* | (2006.01) |

(52) U.S. Cl.

CPC ..... *B41J 2/1652* (2013.01); *B41J 11/0015* (2013.01); *G03G 15/107* (2013.01)

USPC ..... 347/22

(58) Field of Classification Search

USPC ..... 347/20–22, 34

See application file for complete search history.

(56) References Cited

U.S. PATENT DOCUMENTS

| | | | |
|---|---|---|---|
| 5,298,926 | A | 3/1994 | Fukushima et al. |
| 5,774,141 | A | 6/1998 | Cooper et al. |
| 5,896,148 | A | 4/1999 | Fukushima et al. |
| 6,544,484 | B1 | 4/2003 | Kaufman et al. |
| 7,386,247 | B2 | 6/2008 | Doi |
| 7,632,533 | B2 | 12/2009 | Fotland et al. |
| 7,651,212 | B2 | 1/2010 | Kadomatsu et al. |
| 2007/0046764 | A1 | 3/2007 | Nakazawa |
| 2008/0018707 | A1 | 1/2008 | Masuyama et al. |
| 2008/0246803 | A1 | 10/2008 | Barger et al. |
| 2009/0159794 | A1 | 6/2009 | Schleifer et al. |

FOREIGN PATENT DOCUMENTS

| | | |
|---|---|---|
| CN | 101041289 | 9/2007 |
| EP | 0887196 | 12/1998 |

(Continued)

OTHER PUBLICATIONS

PCT, "International Search Report and Written Opinion," issued in connection with PCT Application No. PCT/US2010/054816, dated Apr. 23, 2013 (10 pages).

*Primary Examiner* — Lamson Nguyen

(57) ABSTRACT

Printers, methods, and apparatus to reduce aerosol are disclosed. An example apparatus to reduce aerosol includes a print head to generate droplets and aerosol, and to direct the droplets toward a print substrate, a first corona wire to generate first ions having a first electrical polarity to direct the aerosol toward the print substrate, and a second corona wire to generate second ions to direct the aerosol toward the print substrate, wherein the second ions have a second electrical polarity that is opposite the first electrical polarity.

15 Claims, 10 Drawing Sheets

(56) References Cited

FOREIGN PATENT DOCUMENTS

| | | |
|---|---|---|
| GB | 2324765 | 11/1998 |
| JP | 05000518 | 1/1993 |
| JP | 2006076202 | 3/2006 |
| JP | 2006098808 | 4/2006 |
| JP | 2006175743 | 7/2006 |
| JP | 2006175744 | 7/2006 |
| JP | 2007230034 | 9/2007 |
| JP | 2009258271 | 11/2009 |
| JP | 2009258358 | 11/2009 |
| WO | 2009067096 | 5/2009 |
| WO | 2010114534 | 10/2010 |

PRINTERS, METHODS, AND APPARATUS TO REDUCE AEROSOL

RELATED APPLICATION

This patent arises from the U.S. national stage of International Patent Application Serial No. PCT/US2010/054816, having an International Filing Date of Oct. 29, 2010, which is hereby incorporated by reference in its entirety.

BACKGROUND

Inkjet printers and liquid electrophotographic printers operate by directing small droplets of liquid or dry ink toward a print substrate. In scanning printers, the print head that directs the droplets toward the print substrate and/or the print substrate itself scans in different directions to apply the ink to the different areas of the print substrate.

BRIEF DESCRIPTION OF THE DRAWINGS

Wherever possible, the same reference numbers will be used throughout the drawing(s) and accompanying written description to refer to the same or like parts.

DETAILED DESCRIPTION

Figure 1:
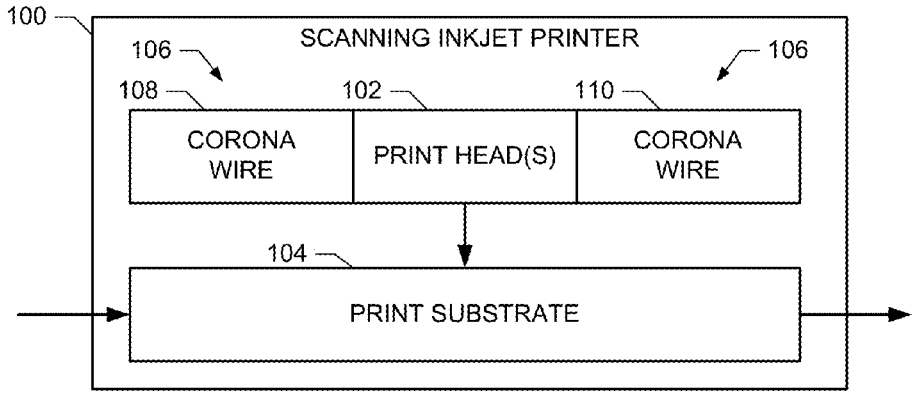
FIG. 1 is a block diagram of an example scanning inkjet printer in accordance with the teachings herein.

FIG. 1 is a block diagram of an example scanning inkjet printer 100. The example printer 100 includes one or more print heads 102 that apply ink to a print substrate 104. The print heads 102 provide one or more liquid marking agents to media the print substrate 104 to form hard images. In some examples, the liquid marking agents may include one or more colors of inks. Different types of inks, such as aqueous, solvent or oil based, may be used depending upon the configuration of the printer 100 and/or the print heads 102. Furthermore, the liquid marking agents may include a fixer or binder, such as a polymer, to assist with binding inks to the print substrate 104 and/or reducing penetration of the inks into the print substrate 104. As used herein, the term "ink" refers to any of the above types of liquid marking agents and/or any other marking fluids that may be ink-jetted.

When the print heads 102 apply the ink to the print substrate 104, the print heads 102 generate ink droplets having a desired size and, as a side effect, generate smaller ink particles. The smaller ink particles, also referred to herein as ink aerosol particles, may not reach the print substrate 104. Instead, at least some of the ink aerosol particles remain suspended in an air layer between the print heads 102 and the print substrate 104. From the air layer, the ink aerosol particles may travel to other parts of the printer 100, such as other print heads 102, and/or may travel outside the printer 100. For example, in the example scanning inkjet printer 100 of FIG. 1, the print heads 102 and/or the print substrate 104 may move rapidly during the printing process, thereby causing air currents that may move the ink aerosol particles within the printer 100 and/or cause the aerosol particles to exit the printer 100.

The ink aerosol particles can cause various problems. For example, when the ink aerosol particles land, they may collect and form deposits on parts of the printer 100. When these ink deposits occur on the print head(s) 102, the print quality of the printer 100 may suffer as the generation of ink droplets of appropriate size may be impeded by the ink deposits. To reduce ink deposits and, thus, increase print quality, the example printer 100 of FIG. 1 includes an ink aerosol reducer 106 that includes first and second corona wires 108, 110. The first corona wire 108 is located on a first side of the print head(s) 102 and the second corona wire 110 is located on a second side of the print head(s). As explained below, the ink aerosol reducer 106 reduces the amount of ink aerosol present in the printer 100. As illustrated in FIG. 1, the first and second corona wires 108, 110 may be located on opposite sides of the print head(s) 102 to contain ink aerosol particles to reduce and/or prevent ink deposits.

Figure 2:
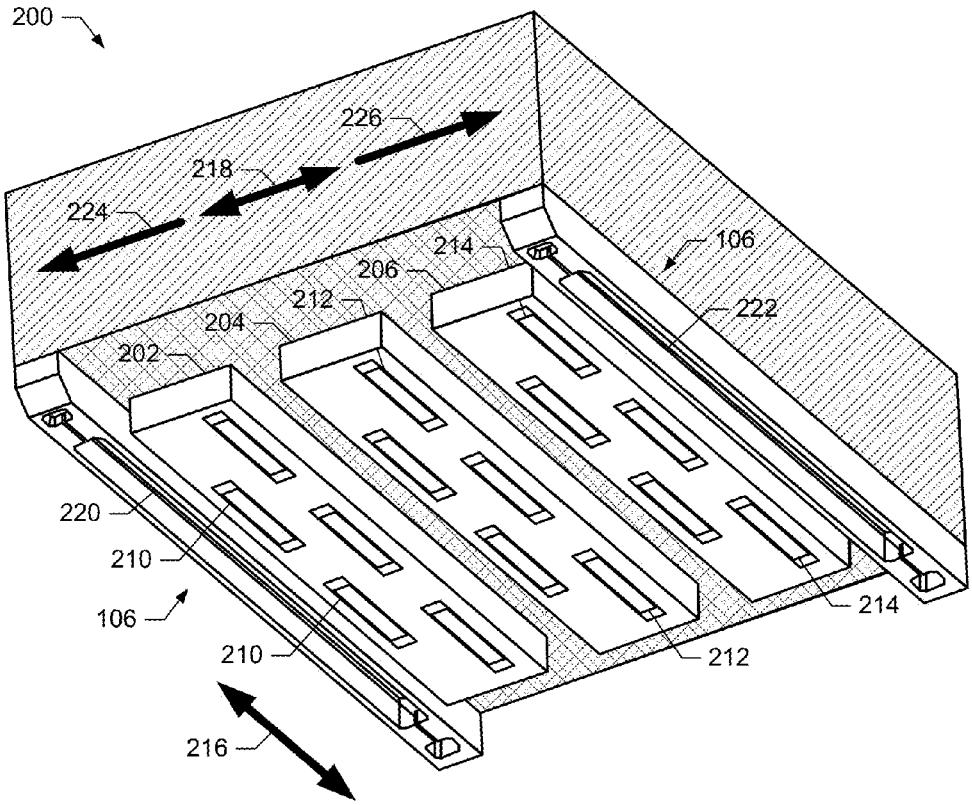
FIG. 2 is a perspective view of an example inkjet carriage including print heads and an ink aerosol reducer in accordance with the teachings herein.

FIG. 2 is a perspective view of an example inkjet carriage 200 including print heads 202, 204, 206, and an ink aerosol reducer 106. The example print heads 202, 204, 206 each include multiple ink nozzles 210, 212, 214. Additionally, each of the example print heads 202, 204, 206 applies a different ink (e.g., different ink color) to a print substrate. As the print substrate travels past the print heads 202, 204, 206 in a direction along a print substrate travel path axis 216, the example inkjet carriage 200 moves the print heads 202, 204, 206 along a scanning axis 218 in a scanning direction. The inkjet carriage 200 of the illustrated example moves the print heads 202, 204, 206 in alternating directions 224, 226 along the scanning axis 218. More specifically, for a first print operation (e.g., printing a row of dots), the carriage 200 moves in a first direction 224. For a second print operation (e.g., printing a second row of dots) following the first print operation, the carriage 200 moves in a second direction 226 opposite the first direction 224. In some other example printers, a platen moves the print substrate along the scanning axis 218 as the inkjet carriage 200 remains stationary.

The example ink aerosol reducer 106 of FIG. 2 includes two corona wires 220 and 222. The example corona wire 220 is a positive corona wire (e.g., generates positive ions) and the corona wire 222 is a negative corona wire (e.g., generates negative ions). In the illustrated example, the corona wires 220 and 222 are located adjacent the print heads 202, 204, 206 on opposite sides of the carriage 200. The example corona wire 220 may be mounted, affixed, and/or attached to the print heads 202, 204, 206 on a first side (e.g., in the first direction 224) and the example corona wire 222 may be mounted, affixed, and/or attached to the print heads 202, 204, 206 on a second side (e.g., in the second direction 226). In some examples, the corona wires 220, 222 may be retrofit onto the print heads 202, 204, 206. When the print heads 202, 204, 206 are moved in the first direction 224, the corona wire 220 is positioned ahead of the print heads 202, 204, 206 relative to the direction of travel, and the corona wire 222 is behind the print heads 202, 204, 206 (again, relative to the direction of travel). Conversely, when the print heads 202, 204, 206 are moved in the second direction 226, the corona wire 222 is positioned ahead of the print heads 202, 204, 206 relative to the direction of travel, and the corona wire 220 is behind the print heads 202, 204, 206 (again, relative to the direction of travel).

Figure 3:
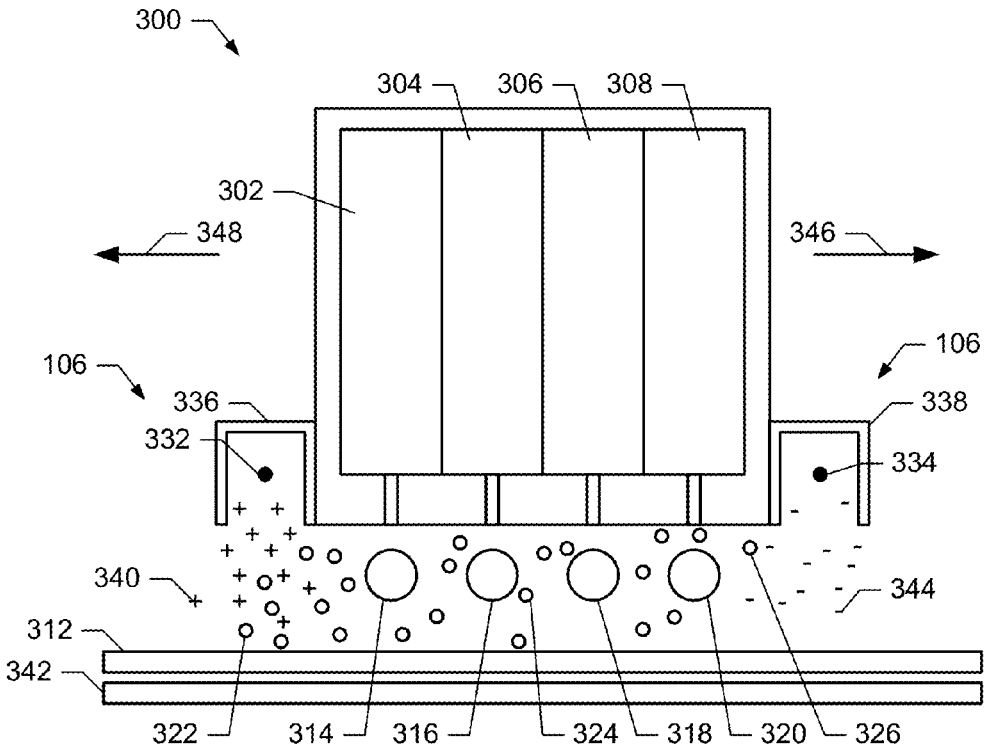
FIG. 3 is a schematic diagram of an example inkjet printer including print heads and an ink aerosol reducer in accordance with the teachings herein.

FIG. 3 is a schematic diagram of an example inkjet printer 300 including print heads 302, 304, 306, 308 and an ink aerosol reducer 106. The print heads 302-308 are located adjacent a print substrate 312. The print heads 302-308 apply ink droplets 314, 316, 318, 320 to the print substrate 312 to form an image. As a side effect of generating the ink droplets 314-320, the print heads 302-308 also generate ink aerosol, represented in FIG. 3 by example ink aerosol particles 322, 324, 326. The ink aerosol particles 322-326 are substantially smaller than the desired ink droplets 314-320.

Figure 4:
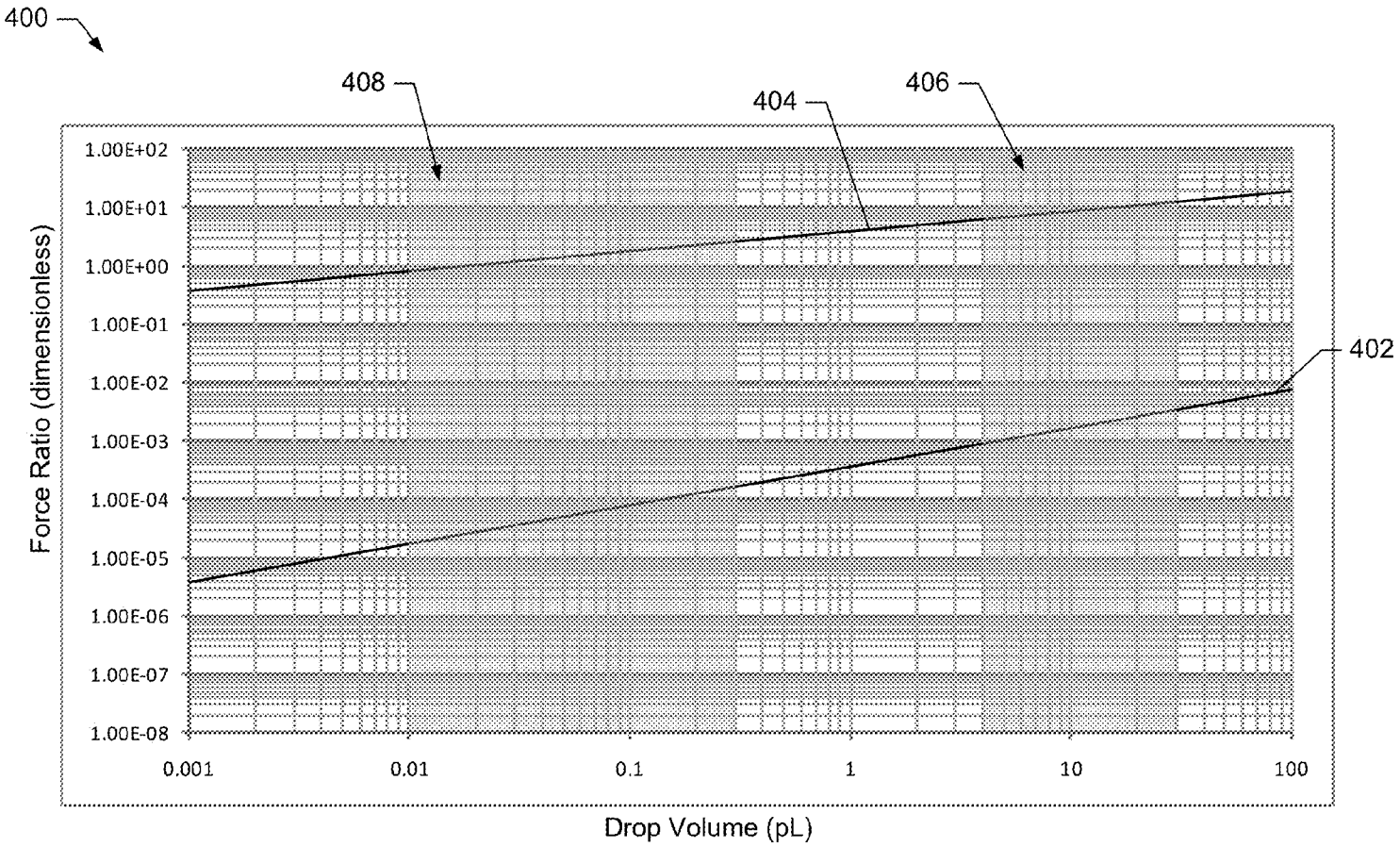
FIG. 4 is a graph of example currents applied to the example corona wires of FIG. 3.

FIG. 4 is a graph 400 of gravitational force to drag force ratios 402 and electrostatic force to drag force ratios 404 for the example ink droplets 314-320 and the example ink aerosol particles 322-326 of FIG. 3. A typical ink droplet size range 406 is illustrated with cross-hatching in FIG. 4. As shown in FIG. 4, the typical drop size range extends from about 4 picoliters (pL) to about 30 pL. A typical ink aerosol particle size range 408 is illustrated with dots in FIG. 4. As shown in FIG. 4, the typical aerosol particle size range extends from about 0.01 pL to about 0.3 pL. As illustrated in FIG. 4, both the gravitational force ratio 402 and the electrostatic force ratio 404 are lower in the ink aerosol particle size range 408 than in the ink droplet size range 406. The force ratios 402 and 404 are low because of the ink aerosol particle size. Therefore, air has a relatively large effect (e.g., via drag forces) on the motion of the ink aerosol particles 322-326. As a result, the ink aerosol particles 322-326 tend to remain in the air instead of landing on the print substrate 312 toward which they are directed by the print heads 302-308. While in the air, the ink aerosol particles 322-326 may be carried to other parts of the printer and settle.

Returning to FIG. 3, the example ink aerosol particles 322, 324, 326, if not controlled, may collect or coalesce on the inkjet printer 300, the print heads 302-308, and/or on other parts of the example inkjet printer 100 of FIG. 1. If ink accumulation occurs on the print heads 302-308, print quality may substantially decrease because the ink accumulation may interfere with the generation of the new ink droplets 314-320.

To reduce the number of floating ink aerosol particles 322-326 and, thus, ink accumulations, the example inkjet printer 300 includes the ink aerosol reducer 106. The example ink aerosol reducer 106 of FIG. 3 includes a positive corona wire 332 and a negative corona wire 334 mounted on different sides of the example print heads 302-308. The positions of the positive corona wire 332 and the negative corona wire 334 illustrated in FIG. 3 may be interchanged. The corona wires 332 and 334 are substantially enclosed by respective covers 336 and 338, but are exposed in the direction of the print substrate 312. The example positive corona wire 332 emits positive ions (schematically represented by "+" signs 340 in FIG. 3) that flow toward the print substrate 312 and a conductive platen 342 below the print substrate 312. The positive ions 340 act as a wall through which the ink aerosol particles 322-326 may not travel to other parts of the printer 300. Similarly, the example negative corona wire 334 emits negative ions (schematically represented by "−" signs 344 in FIG. 3) that flow toward the print substrate 312 and the conductive platen 342. The negative ions 344 act as a second wall through which the ink aerosol particles 322-326 may not travel to the other parts of the printer 300.

As the positive ions 340 and the negative ions 344 are emitted from the respective corona wires 332 and 334, the ions flow toward the print substrate 312 and the platen 342, causing a flow of air from the corona wires 332 and 334 to the print substrate 312. As the print substrate 312 and/or as the inkjet printer 300 moves the corona wires 332 and 334 along the print substrate 312, the ink aerosol particles 322-326 are forced toward the print substrate 312 by the ions 340 and 344. In other words, the respective walls of positive ions 340 and negative ions 344 cooperate to capture the ink aerosol particles 322-326 (e.g., by forcing the ink aerosol particles 322-326 to land on the print substrate 312) that are generated by the print heads 302-308. As a result, the ink aerosol particles 322-326 land on and adhere to the print substrate 312. The ink aerosol particles 322-326 do not adversely affect subjective print quality due to the small size of the particles 322-326. Additionally, the different polarities of the walls of positive ions 340 and negative ions 344 operate to release charges that accumulate on the print substrate 312 and/or on the platen 342.

Print substrates are available in electrically conductive, semi-conductive, and/or non-electrically conductive materials and/or coatings. The platen 342 may alternatively be a non-conductive, a conductive, and/or a semi-conductive platen. When the print substrate 312 and the platen 342 are conductive and in contact with each other, electrical charge that contacts the print substrate 312 may be dissipated and/or, if the platen 342 is grounded, discharge to a ground connection. In contrast, if the print substrate 312 is non-conductive or semi-conductive, a sustained electrical charge may build on the print substrate 312 via the positive ions 340 and/or the negative ions 344 because the print substrate 312 cannot discharge the electrically-charged ions 340, 344 (e.g., via the platen 342). As mentioned above, relatively high amounts of charge may adversely affect the print quality applied to non-conductive or semi-conductive print substrates.

By including the positive corona wire 332 and the negative corona wire 334 (as opposed to two positive corona wires or two negative corona wires), the example inkjet printer 300 avoids building up a sustained charge on a non-conductive or semi-conductive print substrate, which can negatively affect print quality. For example, when a non-conductive or semi-conductive print substrate is sufficiently charged, the charged print substrate may cause deflection of ink droplets from their intended landing locations. Such deflections of droplets can result in blurring of an image, and/or color shifts. The example inkjet printer 300 reduces or avoids charging the print substrate 312 by alternating the polarity of the charges to which the print substrate 312 is exposed. For example, as the inkjet printer 300 moves in a first direction 346 across the print substrate 312, the negative corona wire 334, which is ahead of the print heads 302-308 in the first direction of travel 346, applies a negative charge to the print substrate 312 via the negative ions 344. The positive corona wire 332, which is behind the print heads 302-308 in the first direction of travel 346, applies a positive charge to the print substrate 312 that reduces, cancels, and/or overpowers the negative charge on the print substrate 312. Conversely, when the inkjet printer 300 moves in a second direction of travel 348 across the print substrate 312, the positive corona wire 332 applies a positive charge to the print substrate 312 and shortly thereafter the negative corona wire reduces, cancels, and/or overpowers the positive charge. An example movement of the inkjet printer 300 and the corresponding charging of the print substrate 312 are described in more detail below with reference to FIGS. 6A-6C.

Figure 5:
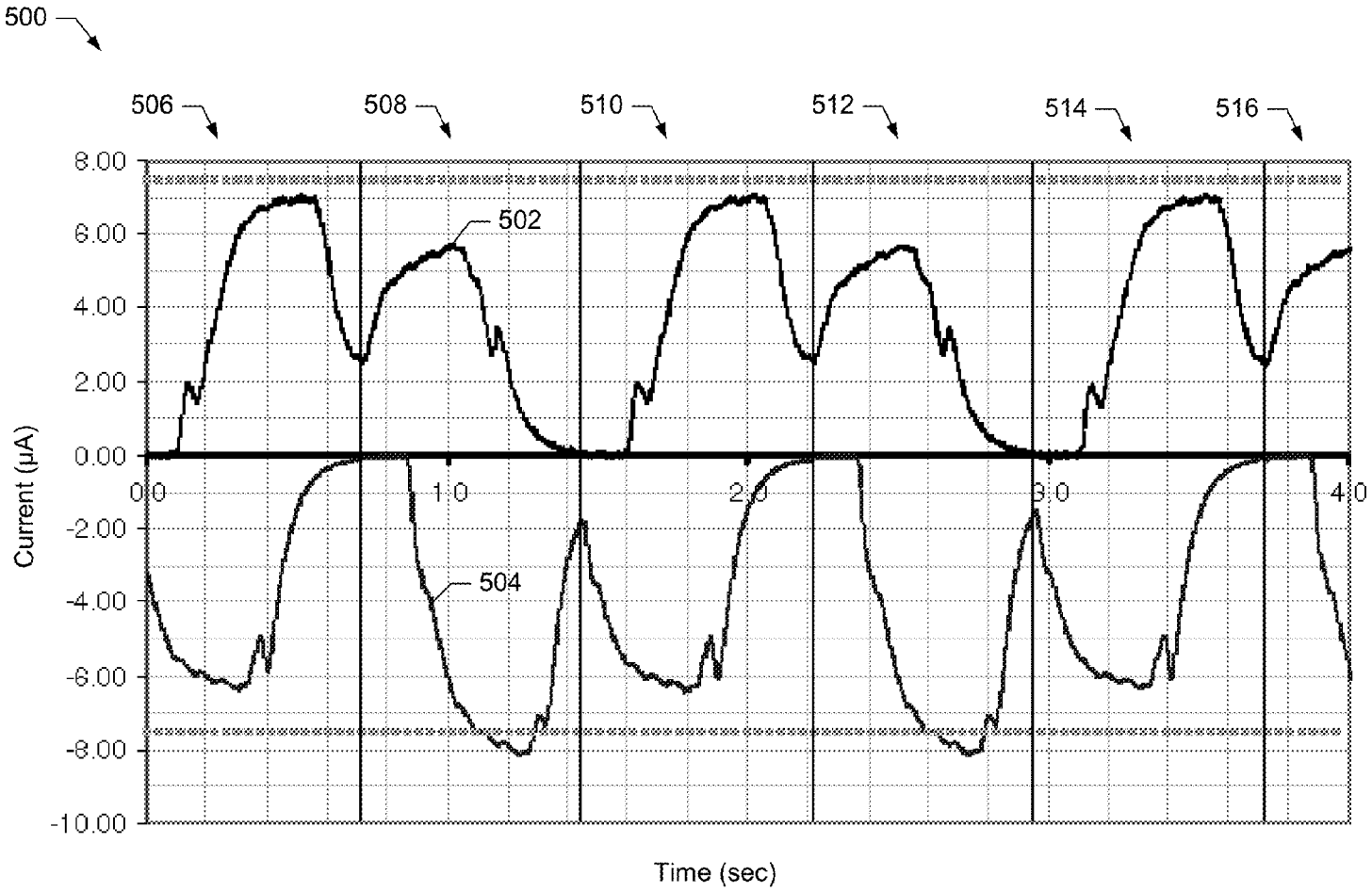
FIG. 5 is a graph of gravitational force to drag force ratios and electrostatic force to drag force ratios for example inkjet droplets and ink aerosol droplets.

FIG. 5 is a graph of example currents 502 and 504 applied to the example corona wires 332 and 334 of FIG. 3. The example currents 502 and 504 may be applied when the example inkjet printer 300 is oscillating between the example directions 346 and 348. In the illustration of FIG. 5, the example currents 502 and 504 are divided into example, substantially equal, time periods 506, 508, 510, 512, 514, 516. During the time periods 506, 510, and 514, the example inkjet printer 300 is moving in the first direction 346 (e.g., considered from a starting position on the left, the negative corona wire 334 moves adjacent the print substrate 312 before the positive corona wire 332 is adjacent the print substrate 312 and leaves the bounds of the print substrate 312 before the positive corona wire 332 leaves the bounds of the print substrate 312). During the time periods 508, 512, and 516, the example inkjet printer 300 is moving in the second direction (e.g., considered from a starting position on the right, the positive corona wire 332 moves adjacent the print substrate 312 before the negative corona wire 334 is adjacent the print substrate 312 and leaves the bounds of the print substrate 312 before the negative corona wire 334 leaves the bounds of the print substrate 312).

The currents 502 and 504 through the respective corona wires 332 and 334 are representative of the amount of generated positive and/or negative ions. To generate the ions, respective positive and negative electrical energy sources (not shown) apply positive and negative voltages to the example corona wires 332 and 334. The number of ions 340 and 344 are generated in proportion to the currents 502 and 504 through the corona wires 332 and 334.

Both positive and negative ions force ink aerosol particles toward the print substrate 312. As illustrated in FIG. 5, at the start of the time periods 506, 510, and 514, the current through the negative corona wire 334 causes the negative corona wire 334 to generate negative ions 344, which forces the ink aerosol particles 322-326 toward the print substrate 312. The current 504 increases as the negative corona wire 334 travels over the print substrate 312 and then decreases when the negative corona wire 334 approaches and reaches the bounds of the print substrate 312. Before the negative corona wire 334 stops generating the negative ions 344 (e.g., reaches the bounds of the print substrate 312 and/or the platen 342), the current 502 increases when the positive corona wire 332 travels over the print substrate 312 and causes the positive corona wire 332 to begin generating positive ions 340.

At the start of the time periods 508, 512, and 516, the current 502 causes the positive corona wire 332 to generate positive ions 340 which, like the negative ions, force the ink aerosol particles 322-326 toward the print substrate 312. The current 502 increases as the positive corona wire 332 travels over the print substrate 312 and then decreases when the positive corona wire 332 approaches and reaches the bounds of the print substrate 312. Before the positive corona wire 332 stops generating the positive ions 340 (e.g., reaches the bounds of the print substrate 312 and/or the platen 342), the current 504 increases when the negative corona wire 334 travels over the print substrate 312 and causes generating the negative corona wire 334 to generate negative ions 344. While the positive and negative ions have the same effect on the ink aerosol particles, the alternating use of positive and negative ions reduces the amount of charge of sustained polarity carried/stored by the substrate 312 and/or the platen 342.

Figure 6A:
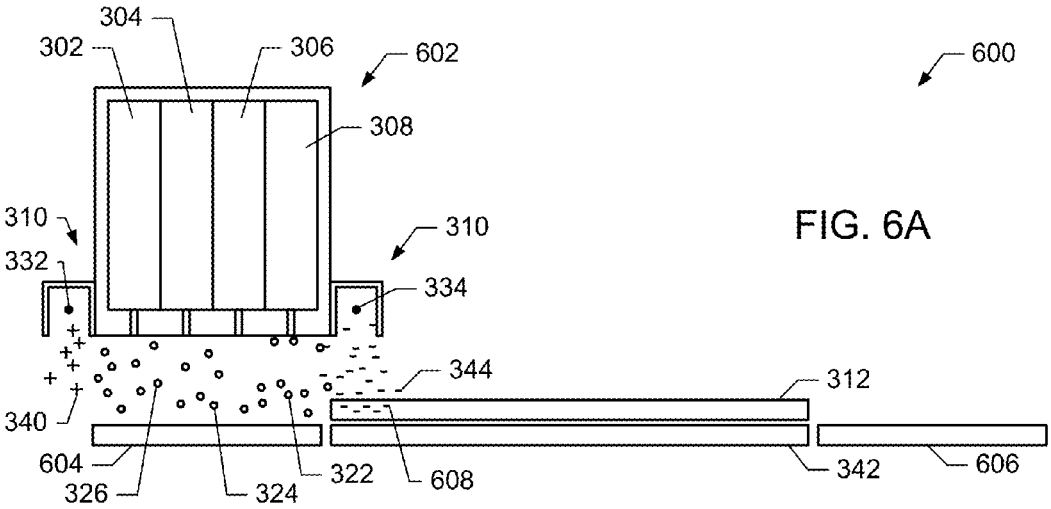
FIGS. 6A-6C are schematic diagrams of the example inkjet carriage as the inkjet carriage scans across a print substrate.
Figure 6B:
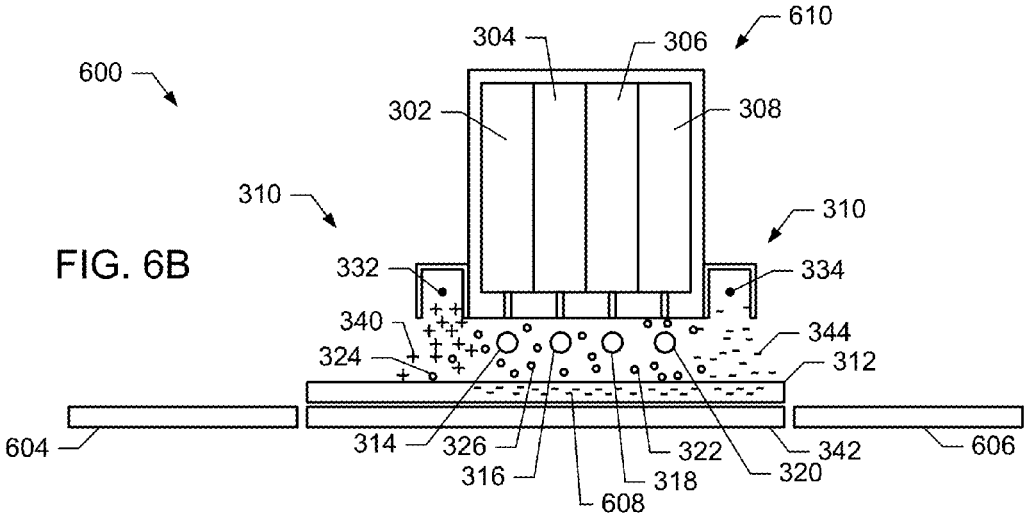
Figure 6C:
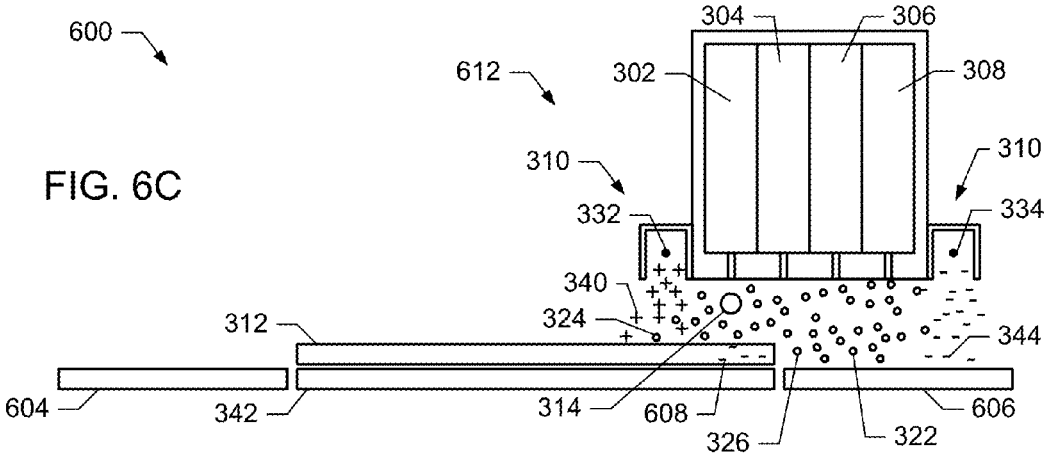

FIGS. 6A-6C are schematic diagrams of an example inkjet printer 600 as the inkjet printer 600 moves across the print substrate 312. The example inkjet printer 600 is similar to the example inkjet printer 300 of FIG. 3, and includes the example print heads 302-308, the example ink aerosol reducer 310 including the positive and negative coronas 342 and 344, and the platen 342. However, the inkjet printer 600 further includes travel limit collection plates 604 and 606 adjacent the platen 342. The example collection plates 604 and 606 lie outside the travel path of the print substrate 312 and, thus, the print heads 302-308 generally do not generate ink droplets when adjacent the collection plates 604 and 606.

FIG. 6A illustrates the example inkjet printer 600 in a first position 602. In the first position 602, the print heads 302-308 are adjacent the travel limit collection plate 604 and do not generate ink droplets. However, ink aerosol particles 322-326 may be present due to air drag caused by the inkjet printer 300 previously moving from a position adjacent the print substrate 312 (i.e., close to the center of FIG. 6A) to the first position 602. Additionally, the positive corona wire 332 is adjacent the travel limit collection plate 604. The positive corona wire 332 may generate positive ions 340 if, for example, the collection plate 604 is conductive. Such positive ions 340 urge the ink aerosol particles 322-326 toward the collection plate 604. On the other hand, if the collection plate 604 is non-conductive, the positive corona wire 332 does not generate ions 340. The negative corona wire 334 is adjacent the print substrate 312 and the platen 342 and, thus, generates negative ions 344. The negative ions 344 urge the ink aerosol particles 322-326 toward the print substrate 312. The negative ions 344 also apply a negative charge 608 to the print substrate 312.

FIG. 6B illustrates the example inkjet printer 600 in a second position 610. In the second position 610, the print heads 302-308 and the corona wires 332 and 334 are adjacent the print substrate 312 and the platen 342. As the inkjet printer 600 moves from the first position 602 to the second position 610, the negative corona wire 334 generates the negative ions 344 toward the print substrate 312. The negative ions 344 urge the ink aerosols 322, 324, and 326 toward the print substrate 312 and create a negative charge 608 on the print substrate 312. The positive corona wire 332 directs the positive ions 342 toward the print substrate 312 that has the negative charge 608. The example positive ions 342 cancel the negative charge 608 and urge the ink aerosols 322, 324, and 326 toward the print substrate 312.

FIG. 6C illustrates the example inkjet printer 600 in a third position 612. In the third position 610, the print heads 304-308 and the negative corona wire 334 are adjacent the travel limit collection plate 606. The print head 302 and the positive corona wire 332 are adjacent the print substrate 312 and the platen 342. Accordingly, the print head 302 generates ink droplets 314 based on a desired image to be printed on the substrate 312. The negative corona wire 334 may generate the negative ions 344 if the collection plate 606 is conductive. Such negative ions 344 urge ink aerosol particles 322-326 toward the collection plate 606. In other examples, when the collection plate 606 is non-conductive, the corona wire 334 does not generate ions 344 when located above the plate 606.

As described above with reference to FIG. 6B, as the positive corona wire 332 moves across the print substrate 312, the positive corona wire 332 generates positive ions 340, which urge the ink aerosol particles 322-326 toward the print substrate 340 and cancel the example negative charge 608 on the print substrate 340.

Together, the positive ions 340 and the negative ions 344 generated by the corona wires 332, 334 create a containment barrier to reduce or prevent ink aerosol particles 322-326 from floating in the air layer indefinitely and eventually contaminating the printer 300 and/or reducing print quality by interfering with the print heads 302-308. As the inkjet printer 300 moves across the print substrate 312 and/or as the print substrate 312 moves during the printing process, the positive ions 340 and the negative ions 344 urge the ink aerosol particles 322-326 toward the print substrate 312. The ink aerosol particles 322-326 are generally small enough that their presence on the print substrate 312 does not affect the subjective print quality of the printed product. In contrast, the accumulation of ink particles on some parts of an inkjet printer over time is likely to affect subjective print quality. Additionally, by using both positive and negative ions to capture the aerosol particles, the example inkjet printer 300 avoids building levels of electrical charge on the print substrate 312 that could affect print quality by interfering with the trajectories of ink droplets toward their intended destinations on the print substrate 312.

In some examples, the ink aerosol reducer 310 is used in combination with an additional corona wire, which is positioned to generate ions to urge ink aerosol particles that travel in a direction normal to the plane of the figures toward the paper. Such a corona wire may be positioned or located after the print heads 302-308 in a print substrate travel direction (e.g., different from the travel direction(s) 346, 348 of the print heads 302-308) to capture ink aerosol particles that are pulled along with the print substrate 312 (e.g., due to air drag) in the print substrate travel direction. An example corona wire that may be used for this purpose is described below in FIG. 12. In some other examples, the corona wires 332 and 334 are positioned around (e.g., encircle, surround) the print heads 302-308. In such an example printer, the corona wires 332 and 334 reduce or prevent the accumulation of ink aerosol particles on the print heads 302-308 and/or on other portions of the inkjet printer 300.

Figure 7:
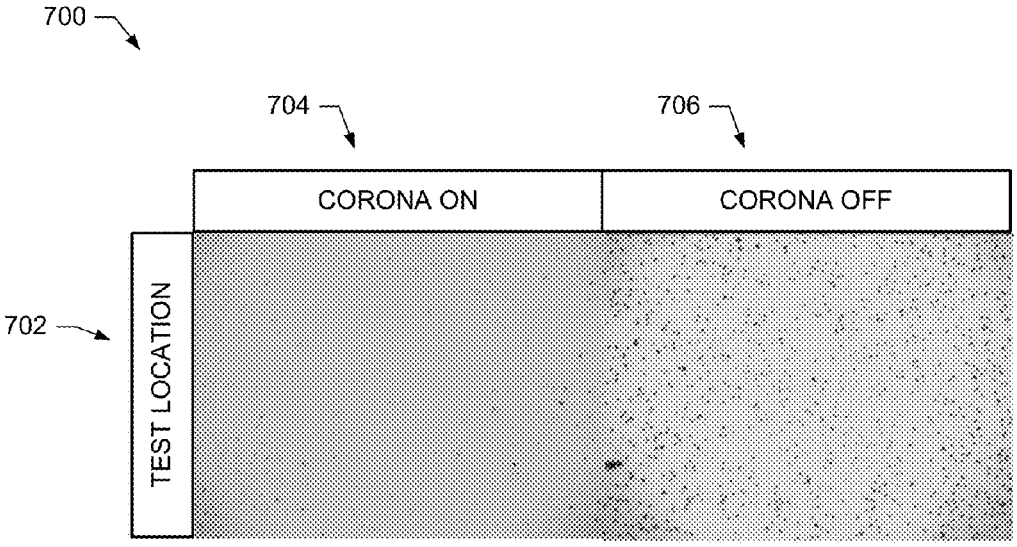
FIG. 7 illustrates a comparison of results between the example ink aerosol reducer of FIG. 3 and a known ink aerosol management system.

FIG. 7 illustrates test results 700 of the example ink aerosol reducer 310 of FIG. 3 and a known ink aerosol management system. The known ink aerosol management system from which the test results 700 were generated uses a vacuum to capture the ambient air and any ink aerosol particles suspended in the ambient air.

The example test results 700 used aerosol capture coupons (e.g., test print substrates such as paper) respectively located in a test location 702 on the outside of the negative corona housing 338. First test results 704 (e.g., CORONA ON) demonstrate the ink aerosol particles that reached the test location 702 and were captured by the aerosol capture coupon when the example ink aerosol reducer 310 was operating. Second test results 706 (e.g., CORONA OFF) demonstrate the ink aerosol particles that reached the test location 702 and were captured by the aerosol capture coupon when the known ink aerosol management system was operating. As shown in FIG. 7, the amount of ink aerosol accumulating on the outside of the negative corona housing 338 of the inkjet printer was substantially lower when the example ink aerosol reducer was used than when the known ink aerosol management system was used.

Figure 8:
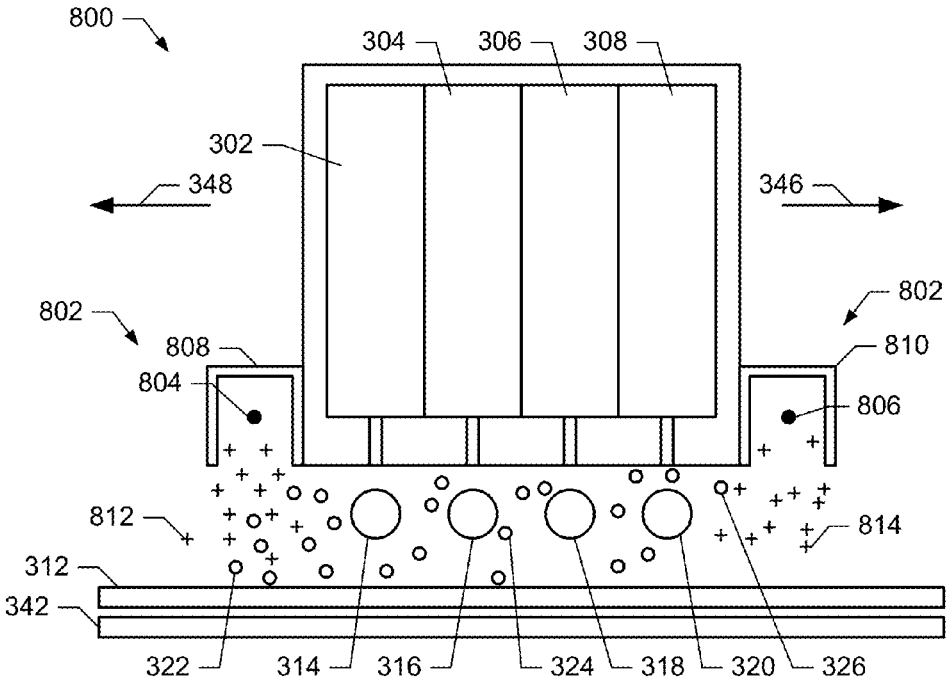
FIG. 8 is a schematic diagram of another example inkjet printer including an ink aerosol reducer in accordance with the teachings herein.

FIG. 8 is a schematic diagram of another example inkjet printer 800 including an ink aerosol reducer 802. The example inkjet printer 800 includes the example print heads 302-308 to apply the ink droplets 314-320 to the print substrate 312. Additionally, the example print heads 302-308 generate unwanted ink aerosol particles 322-326.

The example ink aerosol reducer 802 includes first and second corona wires 804 and 806 and first and second corona housings 808 and 810. In contrast to the example ink aerosol reducer 310 of FIG. 3, which emits ions having different polarities from the different corona wires 332 and 334, the example ink aerosol reducer 802 emits ions 812 and 814 that have the same polarity (e.g., either positive ions or negative ions) from both of the corona wires 804 and 806. While the example ink aerosol reducer 310 of FIG. 3 advantageously reduces a charge on the print substrate 312, the example ink aerosol reducer 802 illustrated in FIG. 8 may be advantageously used with relatively conductive print substrates 312 and/or in applications where charge neutralization is relatively unimportant. The example ink aerosol reducer 802 may be less expensive to implement than the example ink aerosol reducer 310 of FIG. 3, but permits a larger charge to build on the print substrate 312 and may negatively affect print quality in some applications.

Figure 9:
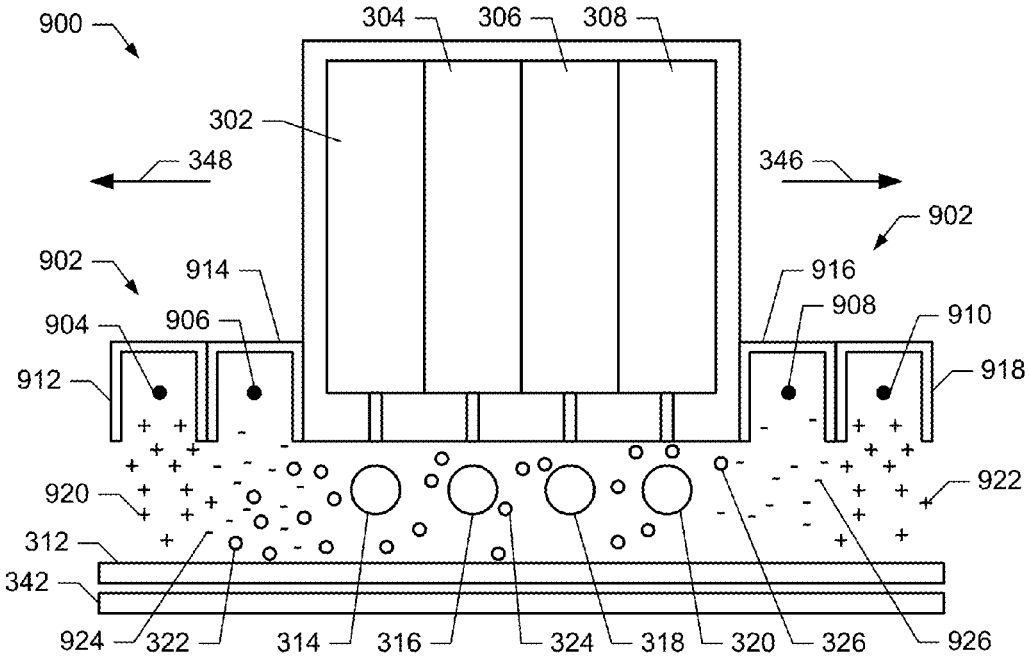
FIG. 9 is a schematic diagram of yet another example inkjet printer including an ink aerosol reducer in accordance with the teachings herein.

FIG. 9 is a schematic diagram of another example inkjet printer 900 including an ink aerosol reducer 902. The example inkjet printer 900 includes example print heads 302-308 to apply the ink droplets 314-320 to the print substrate 312. Additionally, the example print heads 302-308 generate unwanted ink aerosol particles 322-326.

The example ink aerosol reducer 902 includes four corona wires 904, 906, 908, and 910 and corresponding corona housings 912, 914, 916, and 918. The corona wires 904 and 906 are located behind the print heads 302-308 in the first example direction of travel 346 and located ahead of the print heads 302-308 in the second example direction of travel 348. Conversely, the corona wires 908 and 910 are located ahead of the print heads 302-308 in the first example direction of travel 346 and located behind of the print heads 302-308 in the second example direction of travel 348.

The example corona wires 904 and 910 generate positive ions 920 and 922, while the example corona wires 906 and 908 generate negative ions 924 and 926. Both the positive and negative ions 920-926 urge the ink aerosol particles 322-326 toward the print substrate 312. However, in contrast to the ink aerosol reducer 310 of FIG. 3, the example ink aerosol reducer 902 does not leave a charge on the print substrate 312 and/or leaves a smaller charge on the print substrate 312 adjacent the print zone (e.g., the area of the print substrate at which the ink pens 302-308 direct the ink droplets 314-320) because positive and negative ions are present both in front of and behind the print heads 302-308. This reduced charging effect is achieved while still reducing an amount of ink aerosol that settles on the example printer 900. The example ink aerosol reducer 902 may be advantageously used with relatively nonconductive print substrates 312 and/or in applications that are more sensitive to a charge being present on the print substrate 312. The example ink aerosol reducer 902 may be more costly to implement due to the additional corona wires 908 and 910, but may result in higher quality prints than the example ink aerosol reducers 310 or 802 of FIGS. 3 and 8.

Figure 10A:
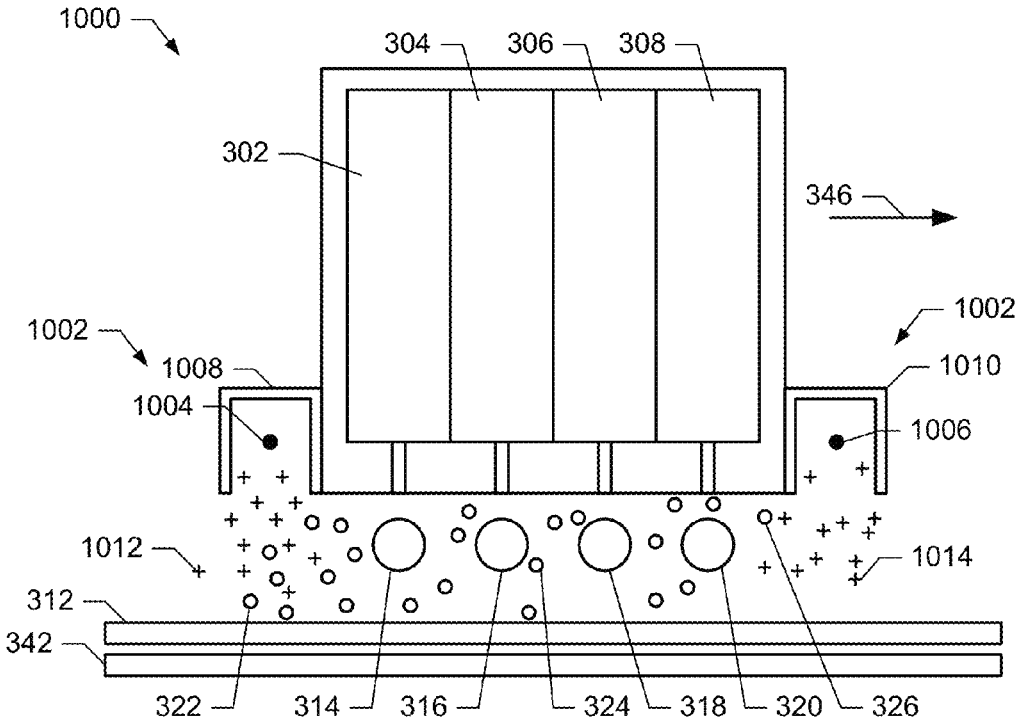
FIGS. 10A and 10B are schematic diagrams of another example inkjet printer including an ink aerosol reducer in accordance with the teachings herein.
Figure 10B:
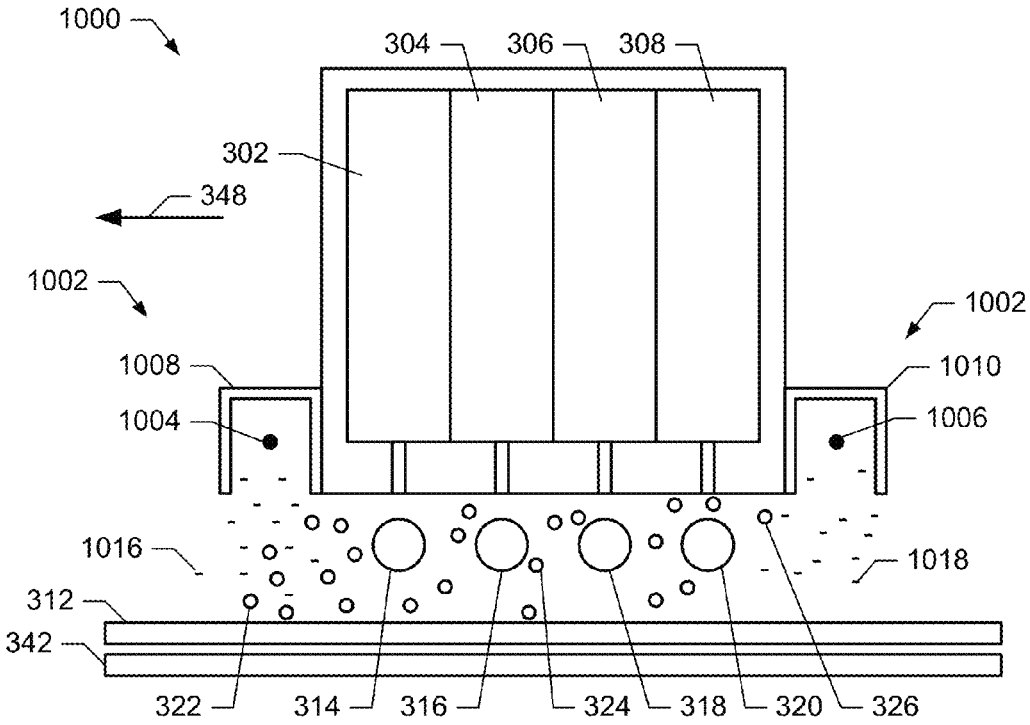

FIGS. 10A and 10B are schematic diagrams of another example inkjet printer 1000 including an ink aerosol reducer 1002. The example inkjet printer 1000 includes the example print heads 302-308 to apply the ink droplets 314-320 to the print substrate 312. Additionally, the example print heads 302-308 generate unwanted ink aerosol particles 322-326. In the illustrated example of FIG. 10A, the example inkjet printer 1000 moves in the first direction 346 as the print heads 302-308 generate the ink droplets 314-320 to the print substrate 312. However, in FIG. 10B the example inkjet printer 1000 moves in the second direction 348 opposite the first direction.

The example ink aerosol reducer 1002 includes first and second corona wires 1004 and 1006 and first and second corona housings 1008 and 1010. Like the example ink aerosol reducer 802 of FIG. 8, the example ink aerosol reducer 1002 emits ions 1012 and 1014 that have the same polarity (e.g., either positive ions or negative ions) from both of the corona wires 1004 and 1006. However, unlike the example ink aerosol reducer 802 of FIG. 8, the example ink aerosol reducer 1002 changes the polarities of the corona wires 1004 and 1006. In the illustrated example, the corona wires 1004 and 1006 emit positive ions 1012 and 1014 when the printer 1000 is moving in the first direction 346. However, the corona wires 1004 and 1006 emit negative ions 1016 and 1018 when the printer 1000 is moving in the second direction 348. Thus, the example ink aerosol reducer 1002 of FIGS. 10A and 10B may be used advantageously to reduce a charge on the print substrate 312. The example ink aerosol reducer 1002 may be more expensive to implement than the example ink aerosol reducer 802 of FIG. 8, but reduces charge buildup on the print substrate 312.

Figure 11:
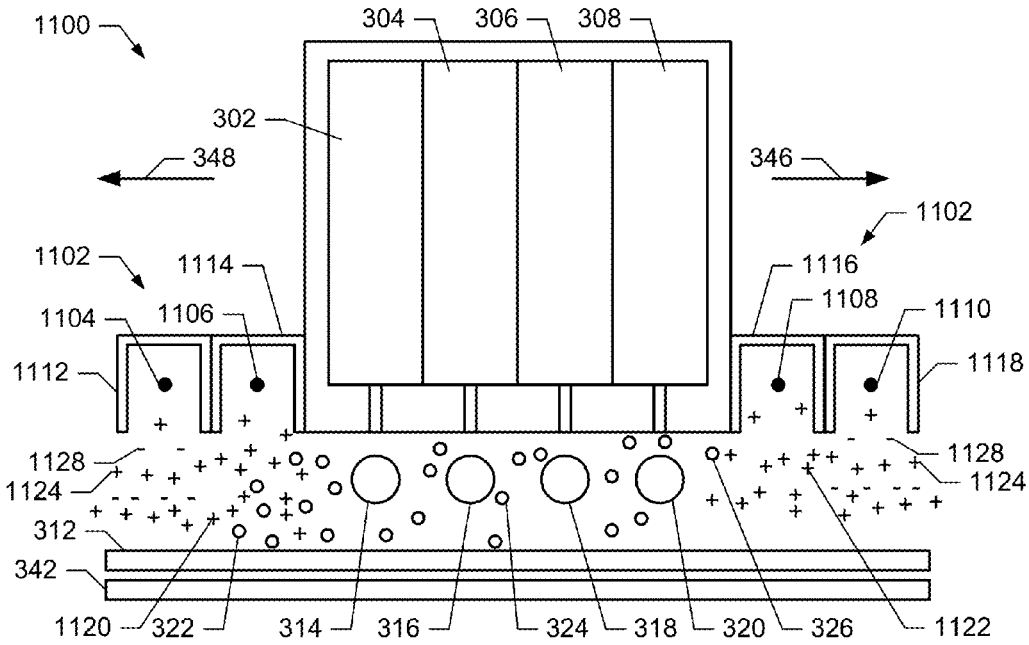
FIG. 11 is a schematic diagram of another example inkjet printer including an ink aerosol reducer in accordance with the teachings herein.

FIG. 11 is a schematic diagram of another example inkjet printer 1100 including an ink aerosol reducer 1102. The example inkjet printer 1100 includes example print heads 302-308 to apply the ink droplets 314-320 to the print substrate 312. Additionally, the example print heads 302-308 generate unwanted ink aerosol particles 322-326.

Like the example ink aerosol reducer 902 of FIG. 9, the example ink aerosol reducer 1102 includes four corona wires 1104, 1106, 1108, and 1110 and corresponding corona housings 1112, 1114, 1116, and 1118. The corona wires 1104 and 1106 are located behind the print heads 302-308 in the first example direction of travel 346 and located ahead of the print heads 302-308 in the second example direction of travel 348. Conversely, the corona wires 1108 and 1110 are located ahead of the print heads 302-308 in the first example direction of travel 346 and located behind of the print heads 302-308 in the second example direction of travel 348.

In the example of FIG. 11, a direct current (DC) signal is applied to the inner coronas 1106 and 1108, and an alternating current (AC) signal is applied to the outer coronas 1104 and 1110. In some other examples, the DC signal may be applied to the outer coronas 1104 and 1110 or to one of the outer coronas 1104 and 1110 and to one of the inner coronas 1106 and 1108, while the AC signal is applied to the inner coronas 1106 and 1108 or to one of the outer coronas 1104 and 1110 and to one of the inner coronas 1106 and 1108.

In the illustrated example, the inner coronas 1106 and 1108 (with DC signals applied) generate positive ions 1120 and 1122 to urge ink aerosol toward the print substrate 312. The outer coronas 1104 and 1110 (with AC signals applied) alternately generate positive ions 1124 and 1126 and negative ions 1128 and 1130 to urge the ink aerosol toward the print substrate 312 and to reduce or eliminate a charge buildup on the print substrate 312. Therefore, the inner coronas 1106 and 1108 contain the ink aerosol and the outer coronas 1104 and 1110 reduce the charge buildup on the substrate 312 that might otherwise be caused by the inner coronas 1106 and 1108. In the example of FIG. 11, the coronas 1104 and 1110 with the AC signal applied are the trailing coronas in the respective first and second directions of travel 346 and 348. Thus, one of the coronas 1104 and 1110 reduces or eliminates the charge on the print substrate 312 after both inner coronas 1106 and 1108 apply the charge.

The frequency at which the AC signals alternate may be based on a scanning speed of the print heads 302-308, an aspect of the print, and/or on any other factor. Additionally, the frequency may be constant and/or may vary. The example ink aerosol reducer 1102 may be more costly to implement due to the additional and/or more complex electrical sources to implement the DC and AC signals, but may result in higher quality prints than the example ink aerosol reducer 310 or 902 of FIGS. 3 and 9.

Figure 12:
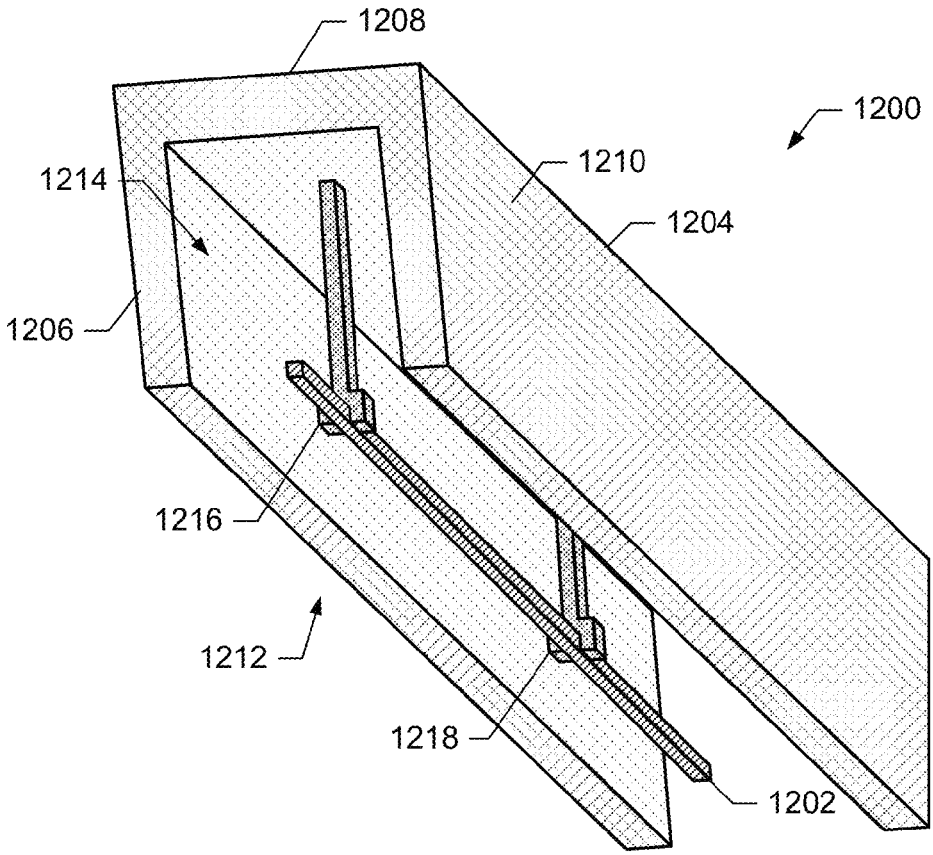
FIG. 12 depicts an example corona bar that may be used to implement the example corona wires of FIG. 1, 3, 6A-6C, 8, 9, 10A, 10B, or 11.

FIG. 12 depicts a cutaway view of an example corona bar 1200. The example corona bar 1200 may be used to implement any of the example corona wires 108, 110 332, 334, 804, 806, 906-910, 1004, 1006, and 1104-1110 of FIGS. 1, 3, 6A-6C, 8, 9, 10A, 10B, and 11. As described above, the corona wire 1202 is coupled to an electrical source, which causes the corona wire 1202 to generate positive and/or negative ions that travel toward a print substrate (e.g., the print substrate 104 of FIG. 1) to urge aerosols toward the print substrate 104.

The example corona bar 1200 includes a corona wire 1202 disposed substantially centrally within an open face 1212 of a housing 1204 of the corona bar 1200. As illustrated in FIG. 12, the example housing 1204 includes three faces 1206, 1208, and 1210, or walls, and the open face 1212. The walls 1206, 1208, and 1210 define a cavity 1214 and the example corona wire 1202 runs substantially the length of the housing 1204.

The example corona wire 1202 spans substantially the entire distance across the print substrate 104 and/or the print head(s) 102. The illustrated corona bar 1200 further includes supports 1216 and 1218, which are in physical contact with the corona wire 1202 and are fixed to the wall 1208. The supports 1216 and 1218 prevent the corona wire 1202 from vibrating in applications in which the corona wire 1202 spans a relatively long distance. The number of supports used may be based on the length of the corona wire 1202. In some examples, one or more of the supports 1216 and 1218 may be replaced and/or complemented by dampers that contact but do not support the corona wire 1202. The supports incrementally reduce the effectiveness of the corona wire 1202 due to the introduction of dead zones at points along the corona wire 1202 that are in contact with the supports 1216 and 1218. If the corona wire 1202 is sufficiently short, the corona bar 1200 may omit the supports 1216 and 1218.

Figure 13:
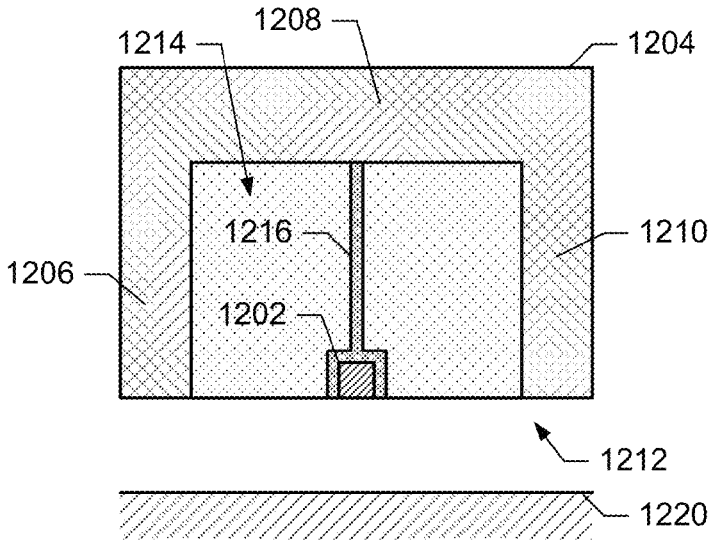
FIG. 13 depicts an example cutaway view of the example corona bar of FIG. 12.

FIG. 13 is a cutaway view of the example corona bar 1200 of FIG. 12. In the view illustrated in FIG. 13, the corona wire 1202, the walls 1206, 1208, and 1210, and the support 1216 are visible. The support 1218 is obscured by the support 1216. The example supports 1216 and 1218 are thin while still capable of supporting and/or preventing the corona wire 1202 from vibrating. The corona wire 1202 does not produce ions over the portions of the corona wire 1202 in contact with the supports 1216 and 1218 and, thus, dead zones may result. Therefore, those portions of the corona wire 1202 in contact with the supports 1216 and 1218 do not contribute to capturing aerosols in the areas between such portions of the corona wire 1202 and the ground plane 1220. However, because the aerosols are substantially mobile, ions from portions of the corona wire 1202 laterally adjacent the supports 1216 and 1218 may capture a significant portion of the aerosols passing through small dead zones.

Additional details and examples of corona wires that may be used to implement the example corona wires 108, 110, 332, 334, 804, 806, 906-910, 1004, 1006, and 1104-1110 described above may be found in U.S. patent application Ser.

No. 12/717,780, filed Mar. 4, 2010, the entirety of which is hereby incorporated by reference.

While the examples described above refer to inkjet printers, the examples may be applied to other types of printers, such as liquid electrophotographic printers and/or laser printers. Several example configurations are described above and illustrated in the figures. However, different aspects of the examples may be combined in many different ways to take advantage of the different benefits of the examples and/or to satisfy a particular application.

From the foregoing, it will appreciate that the above disclosed printers and ink aerosol reducers reduce ink accumulation in inkjet printers that could adversely affect print quality. Additionally, the example ink aerosol reducers may be used with scanning inkjet printers that have multiple directions of travel and therefore cause ink aerosol to be carried in multiple directions by changing air currents generated by the multiple printer movements. The example printers, methods, and apparatus described above may be implemented and/or retrofit onto printers at relatively low cost. Further, the example printers, methods, and apparatus may capture ink aerosol without disturbing the travel paths of desired ink droplets and, thus, do not adversely affect print quality.

Although certain printers and apparatus have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. An apparatus to reduce aerosol, comprising:

a print head to generate droplets and aerosol, and to direct the droplets toward a print substrate;

a first corona wire to generate a first flow of ions having a first electrical polarity to direct the aerosol toward the print substrate; and a second corona wire to generate a second flow of ions to direct the aerosol toward the print substrate, wherein the second ions have a second electrical polarity that is opposite the first electrical polarity.

2. An apparatus as defined in claim 1, wherein at least one of the print head or the print substrate is associated with a first direction of travel, and the first corona wire is located ahead of the print head in the first direction of travel.

3. An apparatus as defined in claim 2, wherein the second corona wire is located behind the print head in the first direction of travel.

4. An apparatus as defined in claim 1, wherein the first flow of ions is to generate a charge on the print substrate and the second flow of ions is to reduce the charge on the print substrate.

5. An apparatus as defined in claim 1, further comprising a collection plate to collect at least some of the aerosol, the collection plate located adjacent a print substrate travel path.

6. An apparatus as defined in claim 1, wherein the aerosol directed at the print substrate does not substantially affect subjective print quality.

7. An apparatus to reduce aerosol, comprising:

a print head to generate droplets and aerosol, and to direct the droplets toward a print substrate;

a first corona wire to generate first ions having a first electrical polarity to direct the aerosol toward the print substrate; and a second corona wire to generate second ions to direct the aerosol toward the print substrate, wherein the second ions have a second electrical polarity that is opposite the first electrical polarity, wherein at least one of the print head or the print substrate is associated with a first direction of travel, and the first corona wire is located ahead of the print head in the first direction of travel, wherein the second corona wire is located between the first corona wire and the print head.

8. An apparatus to reduce aerosol, comprising:

a print head to generate droplets and aerosol, and to direct the droplets toward a print substrate;

a first corona wire to generate first ions having a first electrical polarity to direct the aerosol toward the print substrate; and a second corona wire to generate second ions to direct the aerosol toward the print substrate, wherein the second ions have a second electrical polarity that is opposite the first electrical polarity, wherein at least one of the print head or the print substrate is associated with a first direction of travel, and the first corona wire is located behind the print head in the first direction of travel.

9. An apparatus to reduce aerosol, comprising:

a print head to generate droplets and aerosol, and to direct the droplets toward a print substrate;

a first corona wire to generate first ions having a first electrical polarity to direct the aerosol toward the print substrate;

a second corona wire to generate second ions to direct the aerosol toward the print substrate, wherein the second ions have a second electrical polarity that is opposite the first electrical polarity; and a third corona wire adjacent the second corona wire to generate third ions having one of the first or second electrical polarity and a fourth corona wire adjacent the first corona wire to generate fourth ions having the other of the first or second electrical polarity.

10. An apparatus to reduce aerosol, comprising:

a print head to generate droplets and aerosol, and to direct the droplets toward a print substrate;

a first corona wire on a first side of the print head to generate a first flow of ions to cause a first flow of air from the first corona wire to the print substrate, the first flow of air to force the aerosol toward the print substrate; and a second corona wire on a second side of the print head opposite the first side to generate a second flow of ions to cause a second flow of air from the second corona wire to the print substrate, the second flow of air to force the aerosol toward the print substrate.

11. An apparatus as defined in claim 10, further comprising a collection plate to collect aerosol located adjacent a print substrate travel path.

12. An apparatus as defined in claim 10, wherein the first corona wire generates the first ions based on a direct current and the second corona wire generates the second ions based on an alternating current.

13. A method to reduce aerosol, comprising:

mounting a first corona wire to a first side of a print head; and mounting a second corona wire to a second side of the print head, the first and second corona wires extending substantially in a direction of a travel path of a print substrate.

14. A method as defined in claim 13, wherein the first corona wire is to generate a first wall of ions and the second corona wire is to generate a second wall of ions, the first and second walls to cooperate to capture aerosols generated by the print head.

15. A method as defined in claim 14, wherein the first wall of ions has a first polarity and the second wall of ions has a second polarity, the first and second walls to cooperate to release charge accumulated on at least one of a print substrate and a platen.

* * * * *